United States Patent [19]

Hayashi

[11] 4,412,516

[45] Nov. 1, 1983

[54] LOW-NOISE LEVEL INTERNAL COMBUSTION ENGINE

[75] Inventor: Yoshimasa Hayashi, Kamakura, Japan

[73] Assignee: Nissan Motor Company, Ltd., Yokohama, Japan

[21] Appl. No.: 220,184

[22] Filed: Dec. 23, 1980

[30] Foreign Application Priority Data

Dec. 25, 1979 [JP] Japan ..... 54-180108[U]

[51] Int. Cl.[3] ..... F02B 77/00

[52] U.S. Cl. ..... 123/198 E; 123/195 C; 123/195 S; 181/204

[58] Field of Search ..... 123/198 E, 195 C, 195 S; 181/204

[56] References Cited

U.S. PATENT DOCUMENTS

| | | | |
|---|---|---|---|
| 2,838,129 | 6/1958 | Hesse et al. | 123/198 E |
| 3,464,398 | 9/1969 | Scheiterlein et al. | 123/198 E |
| 3,521,726 | 7/1970 | Freyn | 123/198 E |
| 3,684,053 | 8/1972 | Fachbach et al. | 123/198 E |
| 4,071,008 | 1/1978 | Skatsche et al. | 123/198 E |
| 4,137,888 | 2/1979 | Allan . | |

FOREIGN PATENT DOCUMENTS

| | | |
|---|---|---|
| 695972 | 8/1953 | United Kingdom . |
| 1378585 | 12/1974 | United Kingdom . |

*Primary Examiner*—Ira S. Lazarus

*Attorney, Agent, or Firm*—Schwartz, Jeffery, Schwaab, Mack, Blumenthal & Koch

[57] ABSTRACT

An endless ridge extends along the peripheral portion of each of opposed sides of a cylinder block in a manner to enclose the major portion of the side a soundproof board is sealingly mounted to the ridge in a manner to cover at least the major portion enclosed by the ridge and to define a considerable air space (t) between the outer surface of the major portion and the inner surface of the soundproof board. The soundproof board is constructed of a material having high vibration damping effect and high thermal conductivity.

7 Claims, 2 Drawing Figures

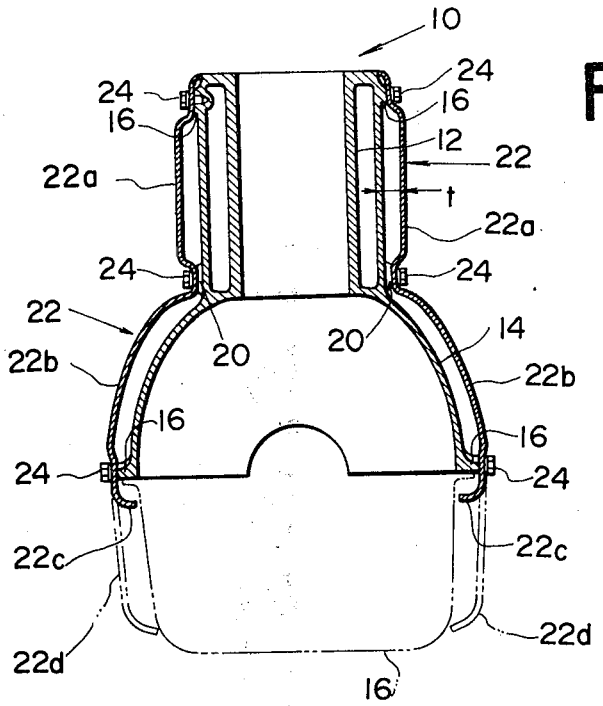
FIG. 1
FIG. 2
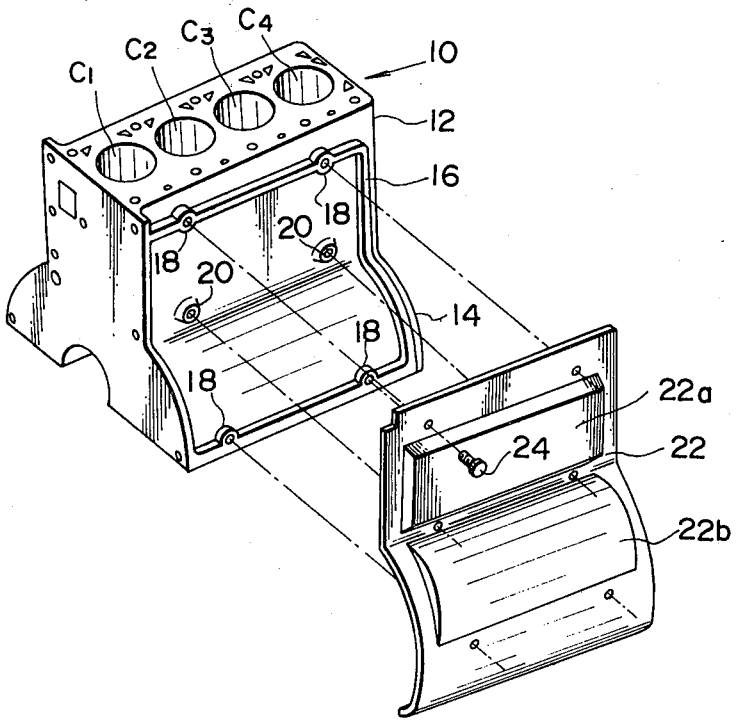

LOW-NOISE LEVEL INTERNAL COMBUSTION ENGINE

BACKGROUND OF THE INVENTION

1. Field of the Invention

The present invention relates to a low-noise level internal combustion engine, and more particularly to an internal combustion engine having means for suppressing engine noise at a considerably low level.

2. Description of the Prior Art

In order to suppress engine noise, there have been proposed two ways: one is to enclose the entire of the engine proper with a soundproof board with projected parts, such as intake and exhaust tubes, fuel supply tube and electric wiring, being exposed to the outside through openings formed in the board, and the other is to cover the lower portion of an engine room of a vehicle.

However, these ways have drawbacks in that in the former way, the entire construction of the engine is bulky and the heat radiation from the engine is poor because the heat emitted from the engine surface is compelled to stay within the engine enclosing soundproof board, and in the latter way, sufficient noise blocking is not achieved because of difficulty in covering the lower portion of the engine room due to obstructions of the steering and suspension parts which are located at that lower portion.

BRIEF SUMMARY OF THE INVENTION

It is an object of the present invention to provide a low-noise level internal combustion engine which has noise suppressing means by which the engine noise is suppressed at a considerably low level.

It is another object of the present invention to provide a low-noise level internal combustion engine which is light and compact in construction.

It is still another object of the present invention to provide a low-noise level internal combustion engine which has no fear about engine overheat.

According to the present invention, there is provided a low-noise level internal combustion engine having a cylinder block with opposed side portions, the engine comprising an endless ridge extending along the peripheral portion of each of the side portions so as to enclose the major portion of the side portion, and a soundproof board sealingly mounted to the ridge in a manner to cover at least the major portion enclosed by the ridge and to define an air space between the outer surface of the major portion and the inner surface of the soundproof board, the soundproof board being constructed of a material having high vibration damping effect and high thermal conductivity.

BRIEF DESCRIPTION OF THE DRAWINGS

The features and advantages of the present invention will be more clearly appreciated from the following description when taken in conjunction with the accompanying drawings, in which:

FIG. 1 is a sectional view of an internal combustion engine according to the present invention, the engine having noise blocking means mounted to the cylinder block thereof; and FIG. 2 is a perspective view of the cylinder block with the noise blocking means being separated from the block.

DETAILED DESCRIPTION OF THE INVENTION

Referring to FIGS. 1 and 2, there is shown a cylinder block 10 of a reciprocating piston internal combustion engine which has noise blocking means mounted to the cylinder block 10. As is known, among the parts of the engine, the cylinder block 10 shows the greatest noise radiation.

The cylinder block 10 shown has a rectangular parallel-piped portion 12 in which four cylinders $C_1$, $C_2$, $C_3$ and $C_4$ are formed, and a radially enlarged skirt portion 14 under which an oil pan 16 (see FIG. 1) is to be located.

The cylinder block 10 is formed at the lateral sides thereof with rectangularly extending endless ridges 16. As is understood from FIG. 2, each of the ridges 16 extends along the peripheral portion of the corresponding side. The top of each ridge 16 is shaped flat throughout the length thereof. The ridges 16 are formed with enlarged portions 18 each having a female screw thread therein. In the embodiment shown, two bosses 20 each having a female screw thread therein are formed on each side of the cylinder block 10 at the conjunction portion where the cylinder defining portion 12 and the skirt portion 14 are united with each other. Now, it should be noted that the ridges 16 and the bosses 20 may be constructed of separate members which are fixed to the cylinder block by welding, caulking or bolting.

Soundproof boards 22 (only one is shown in FIG. 2) are respectively and sealingly mounted on the ridges 16 on the both sides of the block 10 so as to cover at least the side major portions which are enclosed by the ridges 16. As is seen from the drawings, each board 22 is shaped in conformity with the configuration of the corresponding side of the cylinder block 10. For the connection of the boards 22 with the cylinder block 10, bolts 24 are used which are screwed into the enlarged portion 18 and the bosses 20. As is seen from FIG. 1, the lower end portions **22*c* of the boards 22 are bent inwardly that is toward the upper side sections of the oil pan 16. The boards 22 are each constructed of a material having a high vibration damping effect and preferably of a material having a high acoustic absorptivity in addition to the above-mentioned characteristic. For example, as the material of the boards 22**, a phenol resin-reinforced fiber, a polyurethane rubber, a foamed material or a glasswool solidified with suitable binder is usable.

As is shown by FIG. 2, each board 22 is formed with two outwardly expanded portions **22*a* and 22*b*, one 22*a* being located at a portion facing the flat side of the cylinder defining portion 12, while the other 22*b* being located at a portion facing the curved side of the skirt portion 14. With the provision of such expanded portions 22*a* and 22*b*, an air space having a considerable thickness "t" is defined between the side surface of the cylinder block 10 and the inside surface of the board 22**. Experiment has revealed that a suitable value of the thickness "t" of the air space is about 15 mm to 50 mm. When considering the external size of the engine, about 25 mm is the optimum value of the thickness "t".

If desired, each board 22 may be formed with a downward extension **22*d* which covers entirely the corresponding side of the oil pan 16, as is indicated by phantom lines in FIG. 1**.

According to the construction mentioned above, noise which would be otherwise radiated from the engine is prevented from outward radiation by the presence of the soundproof boards 22, so that the noise practically emitted from the engine is greatly suppressed. In this connection, it should be noted that the noise generated within the air space enclosed by the ridges 16 and the boards 22 does not come out directly because of the sealed construction of the space.

Furthermore, even if the vibration generated at the cylinder block 10 is transmitted through the ridges 4 to the soundproof boards 22, the entire constructions of the boards 22 are not subjected to violent vibration because they are constructed of a vibration damping material, so that any noise which would be otherwise produced by the vibration of the boards 22 is not produced.

Furthermore, in the invention, there is no possibility of the undesired engine overheat because of the partial covering of the cylinder block 10. If the soundproof boards 22 are constructed of a material having a considerable thermal conductivity, such as a foamed metal and a metal mesh-embedded polyurethane rubber, the fear about the engine overheat is completely solved. This is because the heat from the engine is quickly transmitted to the boards 22 from which the heat is effectively radiated to the open air.

Although in the embodiment mentioned above, it is described that the soundproof boards are applied to the cylinder block, it is also possible that such boards are applied to a cylinder head, an oil pan, a front cover and a cylinder head cover in substantially the same manner as that mentioned above. Further, the rectangularly extending endless ridges may be formed on the inner surfaces of the soundproof boards.

What is claimed is:

1. A low-noise level internal combustion engine having a cylinder block with opposed side portions, comprising:

an endless ridge extending along the entire peripheral portion of each of the side portions said ridge extending continuously along the entire upper, lower and side regions of each side portion to enclose a major portion of each side portion; and a soundproof board mounted for sealingly contacting the entire surface of said ridge in a manner to cover at least the major portion enclosed by said ridge, said soundproof board, major portion and ridge defining a sealed air space (t) between the outer surface of said major portion and the inner surface of said soundproof board, said soundproof board being constructed of a material having high vibration damping effect.

2. A low-noise level internal combustion engine as claimed in claim 1, in which said endless ridge is integral with said cylinder block and has throughout the length thereof a flat surface to which said soundproof board is sealingly attached.

3. A low-noise level internal combustion engine as claimed in claim 2, in which said soundproof board is formed with at least one outwardly expanded portion so that said air space defined between the surface of the cylinder block and said soundproof board has a predetermined thickness.

4. A low-noise level internal combustion engine as claimed in claim 3, in which said predetermined thickness of the air space is approximately 15 mm to approximately 50 mm.

5. A low-noise level internal combustion engine as claimed in claim 4, in which said predetermined thickness of the air space is approximately 25 mm.

6. A low-noise level internal combustion engine as claimed in claim 3, in which said soundproof board is formed with a downwardly extending extension which covers the entire of a lateral side of an oil pan which is to be located under said cylinder block.

7. A low-noise level internal combustion engine as claimed in claim 1, in which said soundproof board is constructed of a material having high thermal conductivity.

* * * * *